United States Patent [19]

Rhee

[11] Patent Number: 4,635,300

[45] Date of Patent: Jan. 13, 1987

[54] KARATE GLOVE

[76] Inventor: Jhoon G. Rhee, 6210 Chillum Pl., NW., Washington, D.C. 20011

[21] Appl. No.: 714,395

[22] Filed: Mar. 21, 1985

[51] Int. Cl.[4] ..... A41D 13/10

[52] U.S. Cl. ..... 2/16; 2/18; 2/161 A

[58] Field of Search ..... 2/16, 161 A, 18

[56] References Cited

U.S. PATENT DOCUMENTS

| | | | |
|---|---|---|---|
| 3,903,546 | 9/1975 | Rhee | 2/16 |
| 3,924,272 | 12/1975 | Alen et al. | 2/16 |
| 3,945,045 | 3/1976 | Rhee | 2/16 |
| 4,062,073 | 12/1977 | Rhee | 2/16 |
| 4,287,610 | 9/1981 | Rhee | 2/18 |
| 4,290,147 | 9/1981 | Brückner et al. | 2/161 A |

FOREIGN PATENT DOCUMENTS

| | | | |
|---|---|---|---|
| 0054949 | 6/1982 | European Pat. Off. | 2/16 |

*Primary Examiner*—Louis K. Rimrodt
*Attorney, Agent, or Firm*—James C. Wray

[57] ABSTRACT

A unitary flexible protective glove molded of a resilient material and adapted to be easily worn on the hand for use in the art of karate and the like is disclosed. The glove, when worn, covers a portion of the lower forearm, the wrist, and the hand. The portion of the glove covering the wrist and hand is substantially tubular in shape and designed to wrap around the wrist and forearm without the need of any securing means. There is a thumb pocket having on the inside a restraining strap. There is also a grip loop for the index, middle, ring and little fingers which is in close proximity to a finger padding section. The finger padding section and grip loop are held in close proximity by a bridging strap. The glove is designed to facilitate easy insertion of the hand without the need of securing straps.

5 Claims, 5 Drawing Figures

KARATE GLOVE

BACKGROUND OF THE INVENTION

This invention relates to a protective glove adapted to be worn on the hand in the art of karate, kung fu, etc. The art of karate, in particular, is a method developed in Japan, among other places, for defending oneself without the use of weapons by striking sensitive areas of an attacker's body with the hands, elbows, knees or feet. During training in the art and in organized competition, the hands can become badly bruised from extensive use of the fingers, palm, back and sides of the hands, as well as the wrist. The present invention provides a novel covering adapted to protect and prevent injury to the various parts of the hand and wrist as well as prevent injury to the sensitive areas of the body of other persons engaging in the art during training or competition.

SUMMARY OF THE INVENTION

The invention is a device which enables competitions in martial arts to be full contact. That is, the invention enables experts in various modes of hand-to-hand combat to engage in such combat without causing the destruction that unpadded hand-to-hand combat can cause.

Essentially, the device is a wrap-around gripping structure which provides a covering for the lower forearm, wrist, thumb and fingers while allowing the hand to grip substantially in the configuration of a fist. Since the glove does not need any kind of conventional tying or strapping onto the arm, the device has been provided with means for maintaining the covering upon the hand. These means are essentially the thumb pocket and the gripping loop. The thumb pocket is essentially a part of the glove which is deformed and held in the configuration of a pocket by a restraining strap permanently affixed to sides of the material forming the pocket. The thumb is inserted into this pocket and protected by the covering of the glove on the back and sides of the thumb and held in the pocket by means of the restraining strap covering portions of the front side of the thumb or palm side of the thumb.

The grip loop is attached to a forward section of the glove beyond the thumb pocket and on the front or inner side of the glove. The fingers fit between the loop and the back padding section designed to pad the knuckles on the back of the hand. A thickened portion of the covering at the area in contact with the back of the hand is provided for additional shock absorption. The very top of the glove or the forwardmost portion of the glove is bent downward and held in close proximity to the top of the grip loop by means of a bridging strap. The forwardmost portion of the glove is separated from the grip loop by a distance sufficient to allow for the fingers to be inserted therebetween. The bridging strap is an I-shaped structure essentially composed of two flat parallel pieces mutually spaced and connected by a flat vertical piece with the horizontal pieces being permanently affixed to the inner top portion of the glove and top of the grip loop.

To insert one's hand in the glove or covering, one merely needs to pry apart the bottom tubular section of the glove which is slit longitudinally on the front, place one's lower arm in that area, slip one's thumb in the thumb pocket and one's fingers in the area between the grip loop and the topmost portion of the glove, and one may form a fist thereby securing the covering to one's arm.

It is an object of this invention to provide a novel protective glove for use in karate sports and the like which is designed to protect various parts of the hand and wrist of the wearer and which can be easily slipped on or off the wearer's hand.

Another object of this invention is to provide a novel protective glove of simplified construction, relatively inexpensive, and which will obviate injuries to the hand of the wearer and to the body of other persons while engaging in the art of karate, etc.

Another object of this invention is to provide a novel protective glove which is capable of being slipped on and off the hand without the need of lacing or any other securing means.

Another object of the invention is to provide an improvement for a flexible, unitary molded, protective glove for wearing and use in the art of Karate and the like, and adapted to cover the back and sides of the hand including the fingers and thumb and also the entire wrist, comprising a rear portion having a wrist portion, a side portion, a thumb portion partially encircling the thumb, a front portion having a thickened portion, a looped portion, and a finger portion, the improvement for securing various portions of the glove to the fingers and thumbs comprising a restraining strap secured to opposite sides of the thumb portion and having a medial portion spanning the opposite sides of the thumb portion, and opposite end portions, each opposite end portion comprising two wings extending outwardly from ends of the medial portion, one wing being secured to an inner surface of the thumb portion and one to an outer surface of the thumb portion.

In another embodiment, the improvement further comprises a bridging strap secured between the looped portion and the finger portion and having two parallel pieces integrally formed with a medial transverse piece, wherein one parallel piece is secured to the finger portion and the other piece is secured to the looped portion and the medial transverse piece extends between the finger and looped portions defining a passageway for extending the fingers therethrough.

Other features and advantages of the invention will become apparent from the following description of a specific embodiment of the protective glove taken in connection with the drawings.

DESCRIPTION OF THE PREFERRED EMBODIMENT

Figure 1:
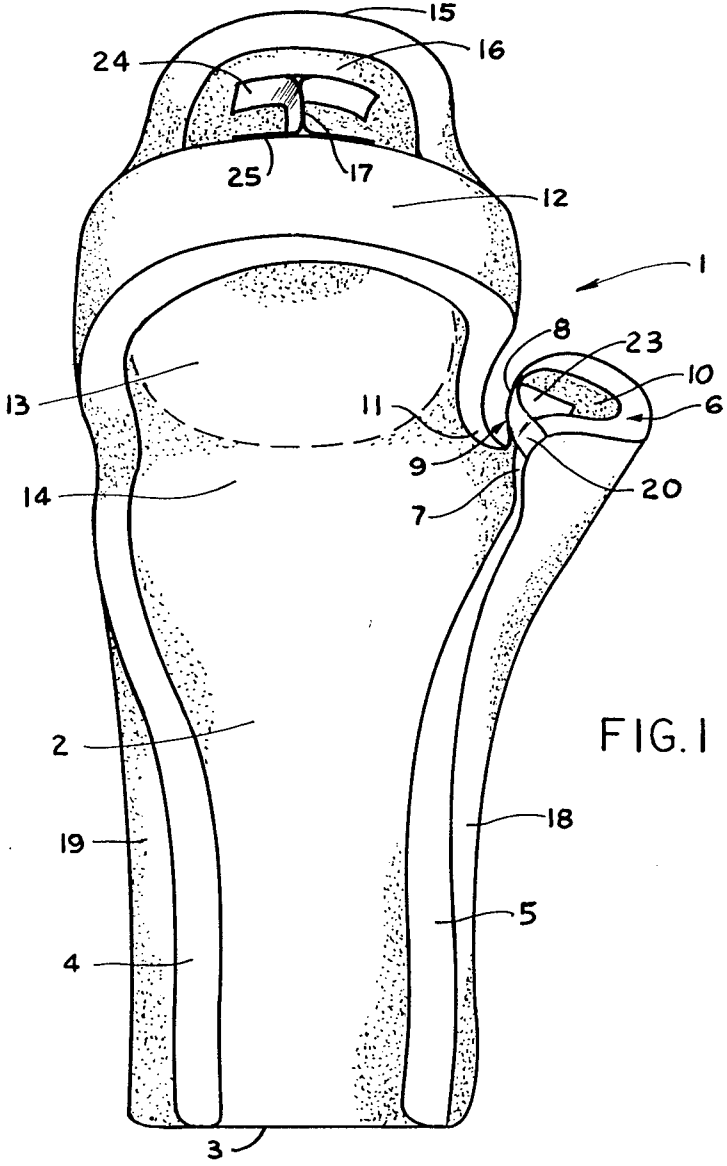
FIG. 1 is a front plan view of the invention.
Figure 2:
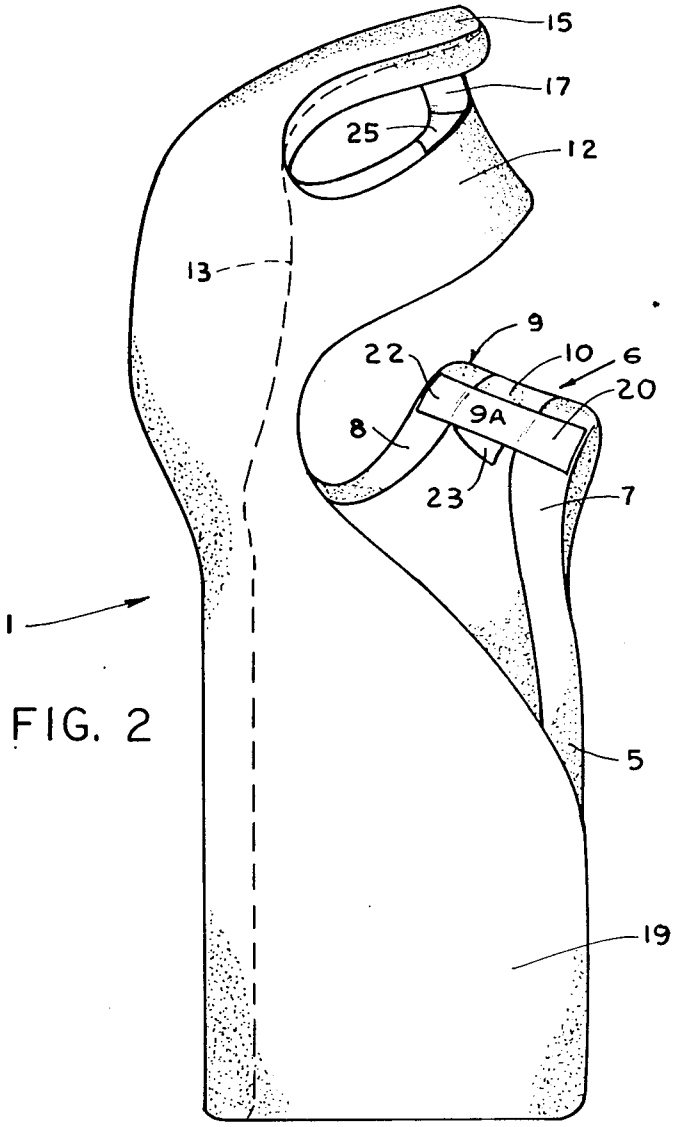
FIG. 2 is a side plan view of the invention.
Figure 3:
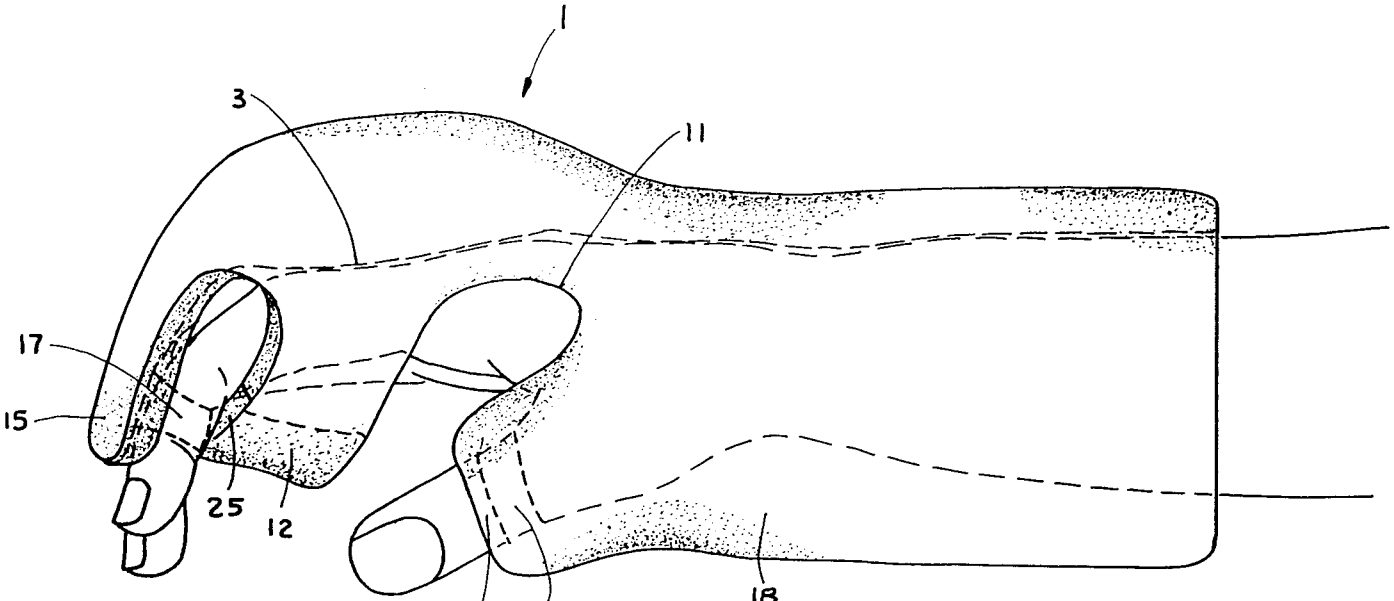
FIG. 3 is another side view of the invention.

FIGS. 1, 2 and 3 show the front and sides of the invention. Looking at FIG. 1, the invention is generally designated by the numeral 1. The lower portion of the glove 2 is designated the trunk section. It is tubular in shape, having a slit forming edges 4 and 5 on the front side and thus dividing the glove into sides 18 and 19. The bottom portion of the invention is generally designated 3.

Located on the top of the tubular section 2 along side 18 is thumb pocket 6. The thumb pocket is essentially a portion of the material comprising the tubular section which has side tabs 7 and 8 held together in essentially parallel alignment by restraining strap 9.

Figure 4:
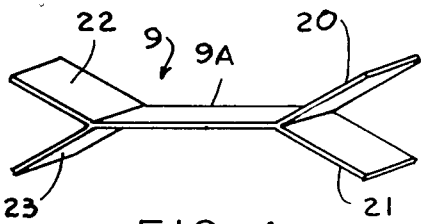
FIG. 4 is an elevated perspective of the restraining strap.

Looking at FIG. 4, the restraining strap 9 is disclosed. Essentially, the restraining strap 9 has two forked ends having wings 22, 23 and 20, 21. Looking at FIG. 2, the position of attaching restraining strap 9 to pocket 6 is disclosed. The restraining strap has a section 9A which spans the distance between side tabs 7 and 8 of the thumb pocket 6. Wings 20 and 22 are attached to the outer sides of the pocket 6. Wings 23 and 21 (not shown) are attached to inner surface 10 of the thumb pocket 6. The methods of attaching restraining strap to the glove may be many but preferably the attachment is permanent. Such methods of attachment as are contemplated by the invention include adhesive bonding, heat bonding and molding with the glove. The restraining strap may be comprised of any resilient plastic material, such as a polyolefin, polyvinyl chloride, rubber, cloth or fabric. The only requirement for the material constituting the restraining strap is that it be tough enough to form the inner side of the thumb pocket and be capable of holding the thumb within the pocket.

Looking at FIGS. 1, 2 and 3, there is a curved indentation on edge 5 at point 11 and edge 4 opposite point 11 which refers to an area of the glove which will be bent forward when the hand is inserted therein and a fist clenched. There is extra padding 13 permanently attached and affixed to the inner portion of the glove. This is to provide extra shock absorption for the hand knuckle area.

Rising from the tubular section of the glove at point 11 and its corresponding point on the opposite side 4 is the topmost or forwardmost section of the glove. Grip loop 12 spans the distance between both sides of this top portion and also causes this top portion to be concave on its inner face. This concavity forms a space for the hand to curve therein.

The fingers are inserted into the area between grip loop 12 and foam pad 13 and are maintained in the space between the top inner portion 16 and the grip loop 12. The top portion 15 is maintained in close proximity to grip loop 12 by means of bridging strap 17.

Figure 5:
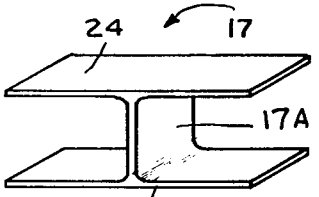
FIG. 5 is an elevated perspective of the bridging strap.

Looking at FIG. 5, the structure of the bridging strap is disclosed. There are two parallel flat pieces 25 and 24 integrally formed with a medial transverse piece 17 parallel piece 24 is permanentaly affixed to the top inner portion 16 and parallel piece 25 is permanently affixed to the top of the grip loop 12. This bridging strap pulls the top or forwardmost portion downward and maintains it in close proximity to the grip loop.

FIG. 3 discloses the invention with the hand inserted prior to clenching. The thumb is shown in thumb pocket 6 being restrained by strap 9. The back knuckles of the hand are padded by pad 13 and the fingertip and joints of the fingers are protected by forward portion 15.

The glove or covering is constructed of a resilient foam material which has preferably a tough outer coating. This resilient material is from one-quarter inch to two inches in thickness and is capable of sustaining substantial shock with minimal permanent compacting. When one clenches one's fist after it has been inserted within the invention, the thumb pocket is pulled towards the inner face 14 (FIG. 1) and the fingers grip the loop 12 pulling the top or forwardmost section 15 downward.

The invention is made of taking a flat thick piece of resilient foam material, preferably polyurethane, polystyrene, rubber, or any resilient material, and shaping the pattern for the glove or covering. The restraining strap of the thumb pocket holds material together for the thumb. The grip loop being initially two wing-like structures emanating from the sides of the pattern, is then brought together and adjoined, which has the effect of pulling the sides of the cut out pattern together, giving the tubular shape to the glove. An extra padding is added on the inner face behind the grip loop to protect the knuckles. The forwardmost section of the glove is attached to the top of the grip loop by the bridging strap.

All bondings pertinent to this invention may be performed in any suitable fashion and by any suitable means. It is preferred that various adhesives be used, but it is recognized that many other methods for adhering the foam to itself as well as the plastic restraining strap and bridging strap to the foam may be used. Such bondings may be by heat welding, chemical welding, stapling, buttoning, sewing, clamping, etc.

It is preferred that once the glove has been initially formed it be coated with a tough resilient outer coating. The marketplace provides numerous products suitable for this purpose. The preferred products are plastic and vinyl in nature. The tough outer coating may be painted, sprayed or dipped on the invention.

While my invention has been described with particularity as to a preferred embodiment, it is to be understood that deviation from the description of the preferred embodiment may occur which will be within the ambit of my invention. The spirit and scope of my invention are set out in the following claims.

What I claim as my invention is:

1. In a flexible, unitary molded, protective glove for wearing and use in the art of Karate and the like, and adapted to cover the back and sides of the hand including the fingers and thumb and also the entire wrist, comprising a rear portion having a wrist portion, a side portion, a thumb portion partially encircling the thumb, a front portion having a thickened portion, a looped portion, and a finger portion, an improvement for securing various portions of the glove to the fingers and thumbs comprising a restraining strap secured to opposite sides of the thumb portion and having a medial portion spanning the opposite sides of the thumb portion and opposite end portions, each opposite end portion comprising two wings extending outwardly from ends of the medial portion, one wing being secured to an inner surface of the thumb portion and one to an outer surface of the thumb portion.

2. The device of claim 1 wherein said restraining strap is a plastic, polyolefin, rubber, or any material which is both flexible and capable of being bonded.

3. The apparatus of claim 1 further comprising, a bridging strap secured between the looped portion and the finger portion and having two parallel pieces integrally formed with a medial transverse piece, where one parallel piece is secured to the finger portion and the other piece is secured to the looped portion and the medial transverse piece extends between the finger and looped portions defining a passagway for extending the fingers therethrough.

4. The device of claim 3 wherein said bridging strap is a plastic, polyolefin, rubber, or any material which is both flexible and capable of being bonded.

5. The apparatus of claim 3 wherein the restraining strap and bridging strap are attached by adhesive bonding, stapling, sewing, heat welding, snapping, riveting or buttoning.

* * * * *